United States Patent [19]

Lehmann

[11] Patent Number: 4,915,345

[45] Date of Patent: Apr. 10, 1990

[54] CONCRETE FORMING SYSTEM FOR CURVED WALLS

[75] Inventor: Larry W. Lehmann, New Braunfels, Tex.

[73] Assignee: Symons Corporation, Des Plaines, Ill.

[21] Appl. No.: 135,024

[22] Filed: Dec. 18, 1987

[51] Int. Cl.[4] ..... E04G 11/10

[52] U.S. Cl. ..... 249/18; 249/10; 249/17; 249/44; 249/144; 249/166; 249/196; 264/32

[58] Field of Search ..... 249/10, 11, 17, 18, 249/40, 48, 135, 144, 153, 155, 159, 165, 166, 179, 184, 189, 190, 192, 194, 196; 264/32

[56] References Cited

U.S. PATENT DOCUMENTS

| | | | |
|---|---|---|---|
| 1,287,573 | 12/1918 | Davidson | 249/184 |
| 1,298,941 | 4/1919 | Harry et al. | 249/184 |
| 2,616,148 | 11/1952 | Hawes | 249/18 |
| 4,185,805 | 1/1980 | Ewing | 249/194 |
| 4,192,481 | 3/1980 | Durbin | 249/219.1 |
| 4,553,729 | 11/1985 | Connors | 249/40 |
| 4,679,763 | 7/1987 | Brotherton | 249/189 |
| 4,742,985 | 5/1988 | Mathis | 249/17 |

FOREIGN PATENT DOCUMENTS

| | | | |
|---|---|---|---|
| 697427 | 9/1953 | United Kingdom | 249/184 |

*Primary Examiner*—James C. Housel
*Attorney, Agent, or Firm*—Charles F. Meroni, Jr.

[57] ABSTRACT

A curved concrete forming structure to provide a 1000 psf system for forming curved walls having a radium in excess of 5'. The structure includes a series of arcuately curved metallic panels secured in stacked side-by-side assembly. The improvement particularly concerns a panel which is comprised of a flexible metallic skin plate. Spaced vertically extending ribs are positioned along the length of the panel on one side thereof. The ribs and the skin plate have essentially the same vertical dimensions. A pair of vertically spaced arcuately curved angles are provided which angles have identical diameters that correspond to the diameter of the concrete wall to be poured using the concrete forming structure. The curved angles are substantially stiffer and inflexible compared to the flexible skin plate. Fasteners secure the curved angles in abutment with opposite ends of the ribs, and with the flexible skin plate being moved from a flat form and secured by the fasteners in a curved form corresponding in diameter to the arcuately curved angles to form said arcuately curved panel, the curved panels being assembled in stacked assembly providing a smooth continuous radius free of chords or flat spots.

37 Claims, 4 Drawing Sheets

CONCRETE FORMING SYSTEM FOR CURVED WALLS

BACKGROUND OF THE INVENTION

Field of the Invention

The present invention relates to a tension type of a modular concrete form or forming structure and method of manufacture thereof. According to my invention, a new and improved curved concrete forming structure is herein disclosed. The structure includes arcuately curved form panels joined together in side-by-side relation as a gang for the formation of curved walls. More specifically, the invention concerns a concrete forming system whereby the panels can be pre-formed at a factory site, if desired, and then shipped to a customer's building site for erection and for the pouring of a curved concrete wall utilizing inside and outside concrete forms which are tied together. By forming the curved steel angles for my form panels at a factory location, it has been found that considerable time can be saved and resultant cost can be reduced because of the reduced amount of labor required to assemble or erect the concrete forming panel.

According to my invention the panels each include a pair of factory formed curved angles for top and bottom edges of each panel and the radii of the angles corresponds to the radii of the concrete wall to be poured. These angles are preferably assembled with steel plates in the factory to reduce cost, but angles having different radii can be interchanged in the field if desired while still avoiding the field problems of attempting to adjust curvatures by the techniques disclosed in U.S. Pat. No. 4,679,763.

According to other improved features of my concrete forming structure, my construction enables a steel skin plate to be flexed to form a desired arc whereby no chording effect will be produced in the poured concrete surface. Unlike convention panel systems that require grinding or rubbing out form joints, my curved concrete forming structure produces a smooth architectural surface that requires minimal finishing labor. My all-steel concrete forming structure provides all the strength and versatility needed even though its form face or skin plate is only 3/16" thick. The curved concrete forming structure has 4" deep vertical stiffners to provide a 1,000 psf system that handles any radius 5' or over, which far exceeds the capabilities of any other known curved concrete forming structure. The 1,000 psf concrete system enables concrete to be poured more quickly in contrast to prior art constructions.

According to important features of my invention pre-rolled steel ribs are used to set the radius of each curved form panel. The curved top and bottom ribs are rolled to a curved shape and serve to securely hold the form in a predetermined radius as required. When assembling the pre-rolled steel ribs with the skins, the skin plate is placed in a position facing the ground, and top and bottom ribs are bolted to vertical stiffners on the backside of the steel skin plate. The panels conform precisely to the radius of the ribs and no torque bolts are needed.

Should a given job require the pouring of walls with a different arc or tanks of a different radius, the builder can simply order extra sets of top and bottom ribs for the same forms.

The panels are adapted to be stacked by bolting the top and bottom ribs adjacent forms with ¾" fit-up bolts and nuts so that the panels can be quickly assembled and disassembled after use.

Typically a form panel consists of a face material stiffeners (or cross-members; side rails (or ribs) and end rails (or end bars). To flex any of the known systems in order to achieve a radius, additional exterior structural elements are used i.e., adjustable curved walers, rolled channels or a tension strap.

According to my invention, a desired radius can be attained by first rolling one of the required panel components, the side rail (or rib) to the required radius. The assembly of the panel then produces a curved panel which is independent of exterior elements. To change curvature, the panel is disassembled and the rolled component is replaced with a like piece which has been pre-rolled to the new curvature. Re-assembly of the panel then produces a new radius which is structurally inherent in the panel once again.

In the past, other types of concrete forming systems have been used and one example is shown in U.S. Pat. No. 4,679,763 assigned to Economy Forms Corporation. In this patent the patentee discloses a metal form which is suited for pouring curved walls. The concrete form is actually formed to a desired curvature at the pour site. The actual curvature of the form is established at the pour site. The principle components of the form are sent in a flat form from the manufacturer to the builder and the builder then makes adjustments in the components of the form after the components have been assembled to establish a desired curvature in the form so that a concrete wall can be poured having a predetermined radius.

Other techniques for forming curved walls are taught in other existing U.S. Patents including U.S. Pat. No. 4,553,729 issued to Frank T. Connors. In this patent, the patentee uses a series of at least three vertically extending rows of concrete form panels which are joined together in side-by-side relation as a gang for use in the formation of straight or curved concrete walls. In this instance, each of the concrete form panels are of a so-called "straight" or "non-curved" construction. Where the radius of a wall is sufficiently large, and the length of the concrete form panels are a small increment of the curvature of the curved wall to be poured, the concrete form panels each function as a chord and co-act in the previously stated environment as a small increment in such a way as to enable a curved concrete wall to be formed. The patentee does not in this patent contemplate the use of curved concrete form panels that are pre-formed to shape in a factory location and then shipped to a job site for installation by a builder in the creation of curved concrete walls.

ADVANTAGES OF MY INVENTION OVER THE PRIOR ART SUCH AS DISCLOSED IN U.S. PAT. 4,679,763

1. My concrete forming structure, and specifically its panels, curve to a smooth continuous radius as opposed to a series of 1'-0" chords or flat sports shown in U.S. Pat. No. 4,679,763.
2. My panel employs a rolled rib to "flex" the panel to shape and to hold it while the 763' Patent requires that a job built templet be used to set the radius. Then a bar is flexed along the back of the panel and bolted. The bolts must be torqued to a certain level to keep the radius from changing due to the panel wanting to straighten out. Torqued bolts are at 6" centers on the panels shown in the 763' Patent and are used on my panels at 1'-0" centers and not for torqued.

3. Pour pressure for concrete forming structure is 1000 psf while it is 800 psf in the 763' Patent, This allows concrete to be poured at a faster rate.
4. My panels can be manufactured having 3'-0, 4'-0, 5'-0, and 6'-0 widths while the panels shown in the 763' Patent are commonly manufactured having only 3', 4', and 5' widths.
5. My panels can be manufactured in 3-lengths, 4', 8', and 12' while the panels in the 763' Patent are commonly in 4' and 12' widths.
6. My panels can be rolled to a 5'-0" minimum radius while the panels in the 763' Patent are commonly manufactured having a 20'-0" minimum radius. This limits the applications where the structural configuration limits in field applications to a 20'-0 radius.

An important object of this invention is to provide a new and improved curved concrete form structures for forming curved walls to reduce labor costs of assembly whereby the components can be shipped with pre-curved components corresponding to the radii of the concrete walls to be poured.

Still another object of this invention is to provide a new and improved method for manufacture, shipping and installing of curved concrete form panels to assist in the formation of curved concrete walls.

According to my invention, the steel angle is rolled to the proper radius using a hydraulically/powered pyramid angle/channel roll. Rolling the angle does not change the metalurgical characteristics of the segment. In rolling, the yield point is exceeded to change and maintain the radius but the cross section of the shape is maintained.

On all panel sizes from 3' wide×4' long up to 6' wide×12' long, the same rolled angle is used. Radii range of the rolled angle is from 5' radius, the smallest, to infinity.

Often an angle is rolled to a certain radius, the radius can be modified, by re-rolling the angle, to a different radius should customer wish to have curved angles reshaped. There are hole layout problems that are occasionally encountered when changing the radius over too large a range so the range of the radius change is preferably limited to +/−5' except at the minimum radius of 5'.

SUMMARY OF THE INVENTION

In a curved concrete forming structure to provide a 1000 psf system for forming curved walls having a radius in excess of 5' and including a series of arcuately curved metallic panels secured in stacked side-by-side assembly, the improvement of the panel including a flexible metallic skin plate, spaced vertically extending ribs positioned along the length of the panel on one side thereof, the ribs and the skin plate having essentially the same vertical dimensions, a pair of vertically spaced arcuately curved angles having identical radii corresponding to the radii of the concrete wall to be poured using the concrete forming structure, the curved angles being substantially stiffer and inflexible compared to the flexible skin plate, and means securing the curved angles in abutment with opposite ends of the ribs, with the flexible skin plate being moved from a flat form and secured by said means in a curved form corresponding in diameter to the arcuately curved angles to form the arcuately curved panel, the curved panels being assembled in stacked assembly providing a smooth continuous radius free of chords or flat spots.

In a method of fabricating an arcuately curved concrete forming panel, the steps of performing relatively stiff arcuately curved angles at a factory location by cutting angle metallic stock in prescribed lengths, punching spaced attachment holes in legs of the angles at predetermined locations, cold rolling the flat angles to a curved shape having a radius corresponding to the curved concrete wall to be formed using the arcuately curved concrete forming panel, sizing a flexible skin plate at the factory location to a customer's requirements, forming and attaching vertical ribs to the flexible skin plate to form a subassembly leaving the plate in a flat flexible form, forming and assembling a pair of the relatively stiff arcuately curved angles along top and bottom edges of the flat flexible skin plate to flex and cause the skin plate to assume the curvature of the relatively stiff unyieldable arcuately curved angles and to thereby provide the panel with a smooth continuous curved forming surface free of chords or flat spots, the arcuately curved concrete forming panel being thereby formed either in a factory or at a pour site thus enabling a manufacturer of the panel to ship the arcuately curved concrete forming panel either in assembled form or in knockdown form.

In a method of fabricating an arcuately curved concrete forming panel, the steps of performing relatively stiff unyieldable arcuately curved angles at a factory location by cutting metallic angle stock in prescribed lengths, punching spaced attachment holes in a leg of the angles at predetermined locations, cold rolling the flat angles to a curved shape having a radius corresponding to the curved concrete wall to be formed using the arcuately curved concrete forming panel, shaping a flexible skin plate at the factory location to a customer's specifications, forming U-shaped vertical ribs and attaching terminal legs in parallel relation to the flexible skin plate to form a subassembly leaving the plate in a flat flexible form, joining and assembling a pair of the relatively stiff arcuately curved angles along top and bottom edges of the flat flexible ribbed plate by engaging fasteners in preformed attachment holes in the angles and thereby causing the plate to flex and assume the curvature of the relatively stiff unyieldable arcuately curved angles to thereby form the arcuately curved concrete forming panel.

BRIEF DESCRIPTION OF THE DRAWINGS

Other objects and features of the present invention will become more fully apparent in view of the following detailed descriptions taken in conjunction with the accompanying drawings illustrating a preferred embodiment, as follows.

DESCRIPTION OF THE PREFERRED EMBODIMENTS

Figure 2:
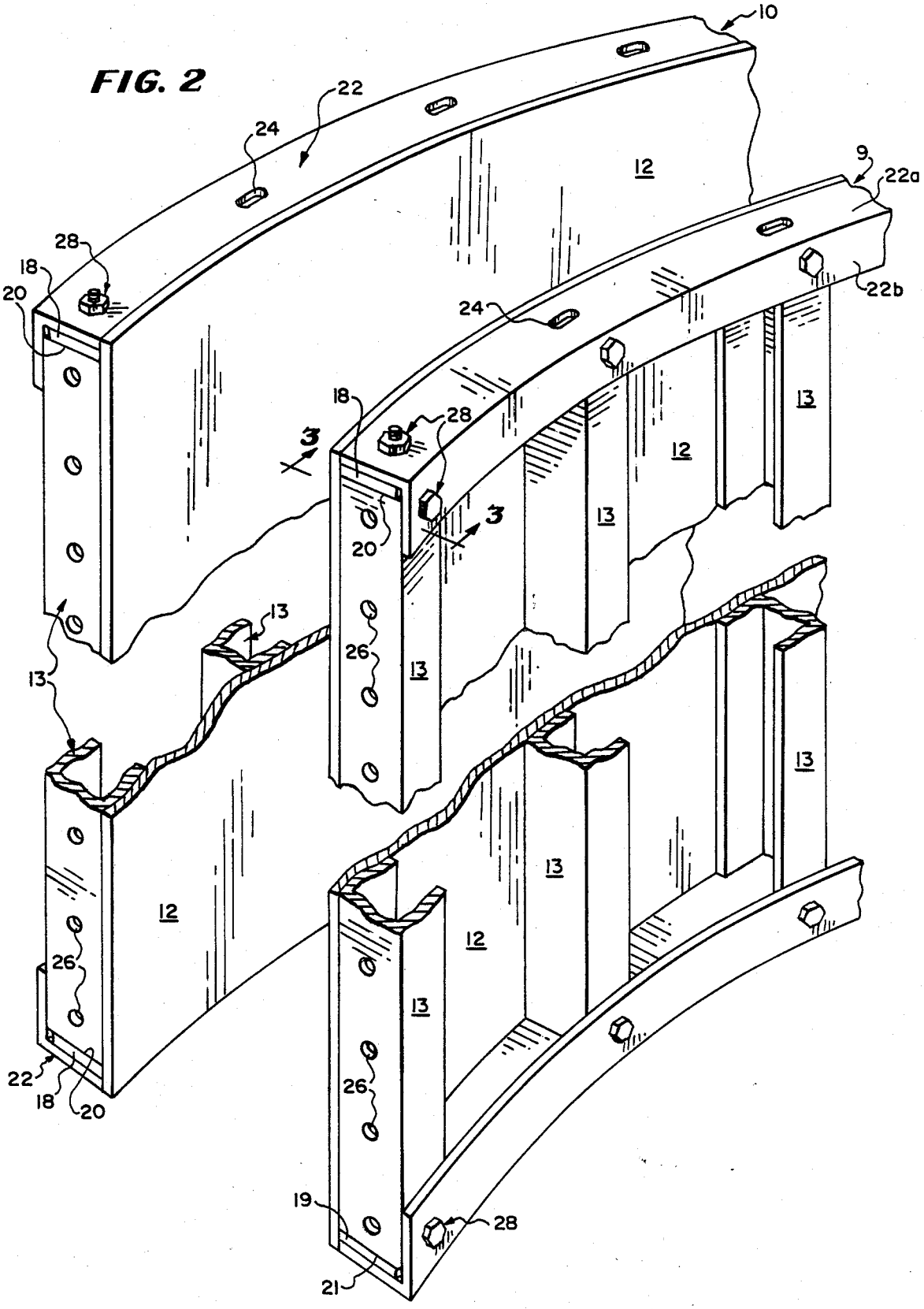
FIG. 2 is an enlarged fragmentary exploded view showing the curved wall in assembled side-by-side relation.
Figure 3:
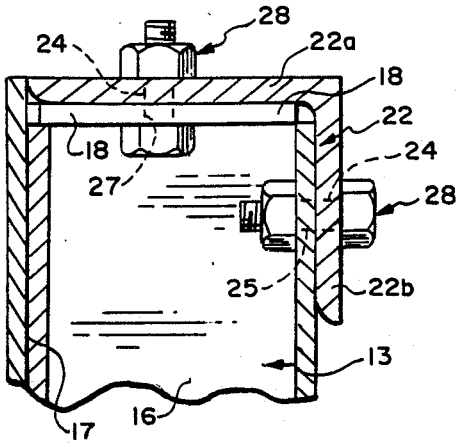
FIG. 3 is an enlarged cross sectional view taken on line 3—3 looking in the direction indicated by the arrows as seen in FIG. 2.
Figure 4:
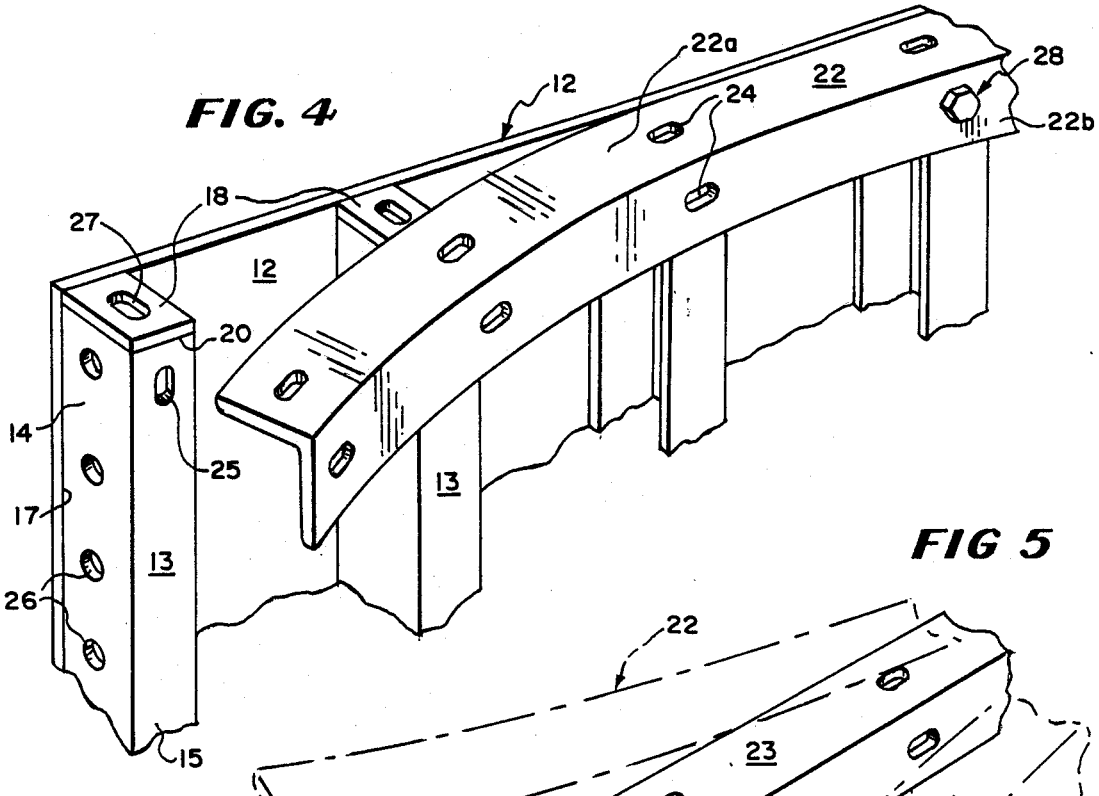
FIG. 4 is an enlarged fragmentary view illustrating the manner in which a panel can be arcuately curved and further illustrating the method of doing so.

According to my invention it is contemplated that my concrete forming structure 8 shall be of an all steel construction and shall include a curved inner form 9 and a curved outer for 10 which are identical. The forms 9 and 10 are each comprised of a series of arcuately curved panels 11 that are securable in stacked side-by-side assembly horizontally and vertically relative to one another. Each of the panels 11 includes a flexible skin plate 12. U-shaped spaced vertical ribs 13 are positioned along the length of the panel 12 at predetermined intervals and are welded in fixed assembly therewith. In this respect, the U-shaped ribs include connected rib legs 14, 15 and 16 with the end rib legs 14 and 16 being welded to the skin plate 12 at their junctures generally noted at 17 (FIG. 4). The flexible steel skin plate preferably has a 3/16" thickness and is backed by the vertical stiffeners or ribs 13 which are preferably 4" deep. The U-shaped ribs 13 and the skin plate 12 have essentially the same vertical dimension. The ribs 13 have closure cap plates 18 and 19 at upper and lower ends thereof (FIG. 2). These cap plates 18 and 19 are secured in welded assembly with the ribs 13 as indicated at 20 and 21 as seen in FIG. 2.

Figure 5:
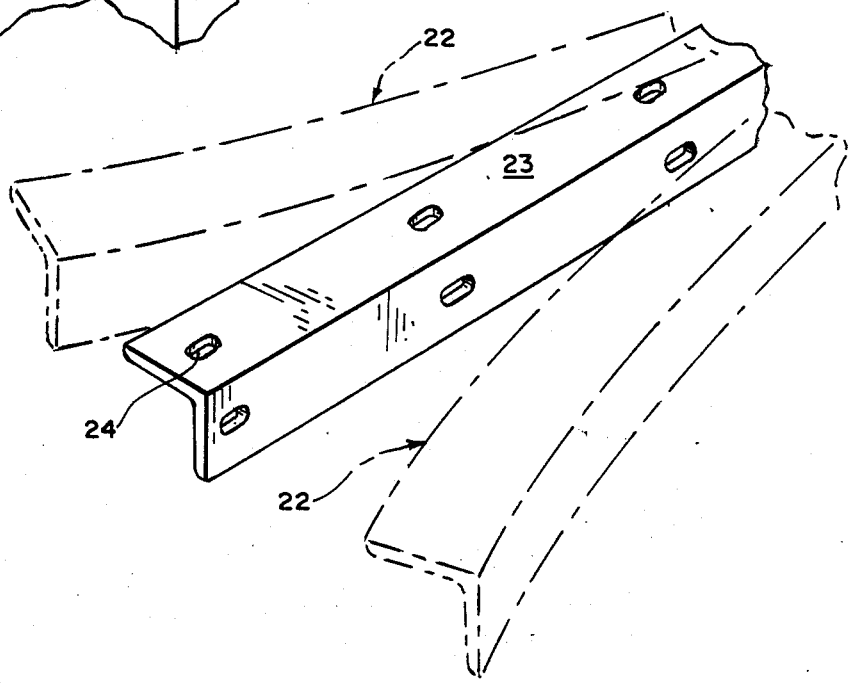
FIG. 5 is an enlarged fragmentary view of an angle shown in full and dotted lines illustrating the manner in which the angle is curved in accordance with my invention.
Figure 6:
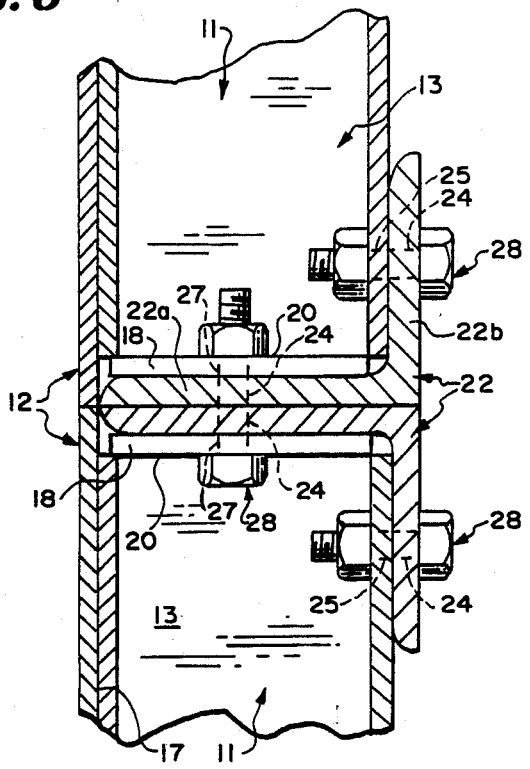
FIG. 6 is an enlarged fragmentary cross sectional view taken on the line 6—6 looking in the direction indicated by the arrows as seen in FIG. 1.

Curved angles 22 are formed in a rolling operation from flat stock 23 as shown in FIG. 5. Each of the curved panels 11 has a pair of vertically spaced arcuately curved angles 22—22. The angles 22—22 have indentical radii corresponding to the radii of the concrete wall to be poured.

In the formation of the angle 23 from flat stock to the proper radius, consideration must be given to its physical and its metallurgical characteristics. It is a standard hot rolled angle 23, ASTM A-36, 4"×3"×3/8", which is rolled by many steel mills. The angle 23 is purchased in standard 40'-0" lengths from available suppliers. In buying the standard angle from mills, there are "mill tolerances" which must be accepted constituting variations in leg lengths and thickness. These variations are listed in standard steel handbooks and are accepted by everyone in the steel industry. The present concrete forming system has been constructed to accommodate the mill tolerances. As a standard steel shape, the angle can be used for anything the assignee produces, therefore it is inventoried as raw material. It is then drawn from inventory as required.

When an order is received, the angle 23 is drawn from inventory. If the radius is to be 40'-0" or larger, the angle is sheared on an angle shear to exact length. Two sets of holes or slots 24 are then punched on a rack punch (which spaces the holes) into horizontal or lapped angle legg **22*a* and into upright angle leg (FIG. 4) and then the angle is rolled on an angle roll. (The lapped angle leg 22*a* laps the end of the rib 13 when assembled.) If the radius is less than 40'0" the entire 40' length is rolled, burned to exact length, and the holes 24** are punched on the rack punch in accordance with a predetermined hole layout on a templet.

It has been found that in the rolling and cutting of the angles 22 above and below 40' radius, that there is a greater tendency for the angles to stretch and to distort on the tighter radii. This is the hole layout problem mentioned before. It has been further found that each phase of the manufacture of the angle from inventory to punching and rolling, the angle 23 distorts more at the holes 24 than between the holes.

Several years ago preliminary work was conducted involving heavy-duty forms for tunnels and shafts. It was determined customers would buy panels which could go from job to job and the customer could buy ribs to fit the job. This was experimental with changes and refinements being made on each job.

These early forms differed from the modern rentable forms herein disclosed in almost every detail with the only common thing being the skin plates were re-used on different radii. The early experimental forms had ¼" thick skin plate, large mill-rolled channel stiffeners, and deep burned ribs with welded flanges. The attachment of the ribs to the panels differed from job to job, which is now constant. The early forms were used in shafts and tunnels where the outside surface of the concrete would be formed by the earth. There was no outside forms and no ties between the inside and outside. They were always a compression ring and were not designed to be used in tension. We built the forms to match the job. This made the panels different on every job.

According to my invention, the panels are now built, then the panels are fit to the job and they can be used on inside and outside surfaces with internal and over-the-top ties. The new forms here disclosed each use a 3/16" thick skin plate with bent plate channel stiffeners. Bent plate is used because of the accuracy of its dimensions compared to mill-rolled sections which have tolerances either plus or minus. There is the roller rib (angle 4×3×3/8), that attaches to the panel thru the bent plate stiffener and the leg of the angle which pulls the skin plate into the proper radius. The panel is complete with an angle, rolled to the proper radius, and bolted top and bottom.

In order to assemble components of my panel together and to each other, rib slots 25 and rib holes 26 are provided (FIG. 4). Also, the cover plate 18 is provided with cover plate slots 27 (FIG. 4), for securing these components as illustrated in the drawings, I have employed bolt and nut fasteners or fastener assemblies 28. When the panels are assembled together, the skin plate 12 on each panel co-acts with all other skin plates on adjacent panels to provide a smooth continuous radius free of cords or flat spots in contrast to the teachings of the prior art on other all metal panels such as are shown in U.S. Pat. No. 4,679,763.

Figure 7:
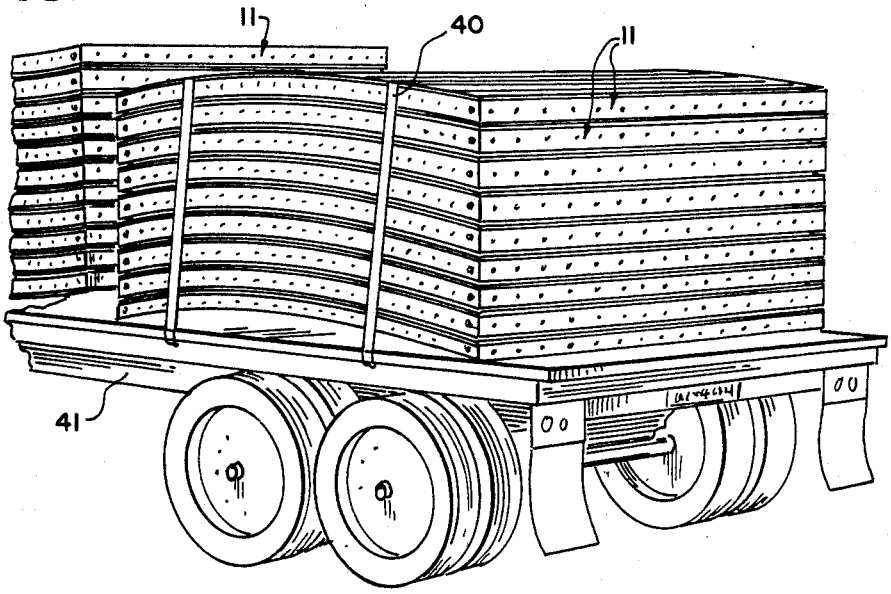
FIG. 7 is an enlarged fragmentary perspective showing the manner in which the formed arcuately curved panels are stacked and carried upon a flat bed truck to a customer for final assembly and use in a curved concrete forming structure.

The pre-rolled steel ribs 13 are bolted to the flexible skin plate or panels 12 to lock in the radius when this subassembly is subsequently secured with the curved angles 22—22. The panel can then be shipped preassembled from the factory to the job site to simplify job site work (FIG. 7). This design eliminates costly templates as required by the prior art.

The forms 9 and 10 are provided with top tie/lift brackets 30 and 31. These brackets are suitably bolted to the curved angles 22 as indicated at 32. Tie bolt and nut assemblies 33' secure the forms 9 and 10 in a proper spaced relation relative to one another after they have been secured with opposed lift brackets 30 and 31 (FIG. 1).

Tie bearing brackets 33 are bolted at 34 to the ribs 13 and the curved angle 22. These brackets 33 are installed at pre-drilled tie locations to accommodate 50 Kip Shebolts or Taper Ties 35. The ties serve to assist in the securement of the inner and outer curved forms 9 and 10 in predetermined spaced relationship to provide the curved concrete forming structure 10 that is adapted to receive concrete to provide a 1,000 psf system as previously described. Alternative tie holes 36 are provided to permit versatility in the tie placement when the inner and outer forms 9 and 10 are secured together.

Figure 1:
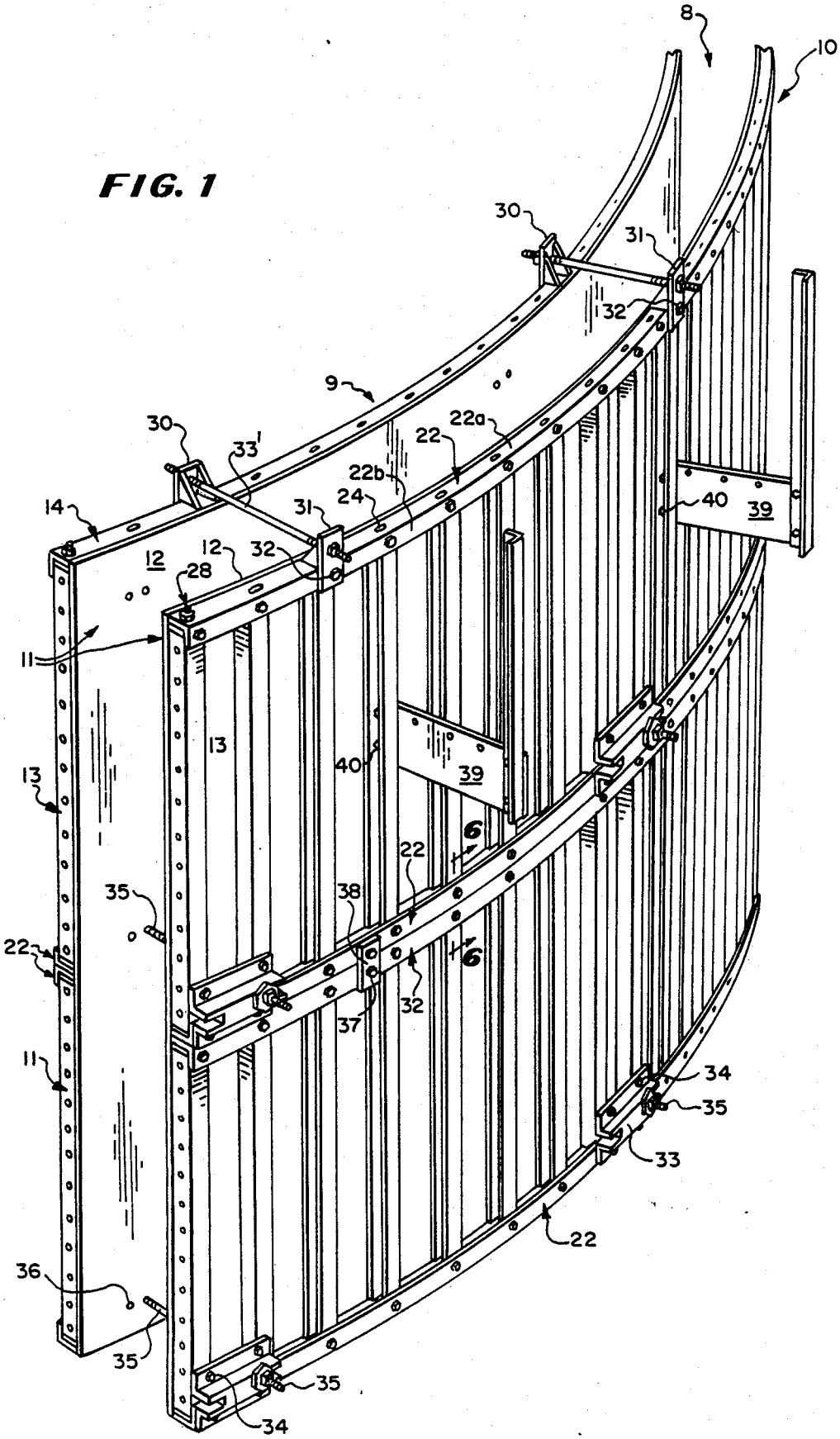
FIG. 1 is a perspective view of my curved concrete forming structure embodying important features of my invention.

Aligner plates 37 are bolted at 38 to the adjacent curved angles 22—22 when the panels 11—11 are stacked on top of one another as shown in FIG. 1. These aligner plates 37 serve to insure vertical alignment of the stacked curved panels 11,11 and serve to eliminate the need for walers in most applications.

Walkway brackets 39—39 are bolted at 40 to the vertical stiffeners or ribs 13 for safe, positive connection wherever needed. A contractor can simply add lumber to these brackets to meet OSHA scaffolding requirements.

One additional difference between the earlier experimental forms for tunnels and shafts and the new form herein disclosed involves the way in which the stacked panels are bolted together.

The earlier experimental forms had large burned ribs, had a complicated series of alternate holes in the rib that allowed the rib to be bolted onto the panels, and then when the panels were bolted together, the heads of the bolts would nest into a hole on the adjacent rib. With my new herein disclosed form, the bolts go thru the 2-rib plus the plate welded to each end of the stiffeners. My new form has been greatly simplified as compared to the experimental ones that were first developed.

After a customer has placed an order for a concrete form structure 8 capable of forming a curved concrete wall having a given radius. The panels can be formed as previously described if not already in stock and a group of the panels 11 are strapped together as indicated at 40 in FIG. 7 and shipped on a flat bed truck 41 to the customer for installation to a job site where the curved concrete wall is to be built.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. In a curved concrete forming structure to provide a system for forming curved walls and including a series of arcuately curved metallic panels secured in stacked side-by-side assembly, the improvement wherein each panel includes a flexible metallic skin plate, spaced vertically extending ribs secured along the length of the plate on one side thereof, the ribs and the skin plate having essentially the same vertical dimensions, a pair of vertically spaced arcuately curved angles having identical radii of curvature corresponding to the radii of curvature of the concrete wall to be poured using the concrete forming structure, the curved angles being substantially stiffer and inflexible compared to the flexible skin plate, said curved angles each having an upright angle leg and a horizontal angle leg, and means securing the curved angles in abutment with said panel, an outer terminal end of the horizontal leg being free of any upright angle leg, said outer terminal end being remote from the upright angle leg, said upright angle leg being flatwise engaged against said ribs spaced from the skin plate and said outer terminal end being positioned for continuous edgewise engagement against said skin plate when said means causes said flexible skin plate to be flexed from a flat form into a curved form and then engaged in reinforced abutment with the relatively stiffer arcuately curved angle, the curved panels being assembled in stacked assembly providing a smooth continuous radius free of chords or flat spots.

2. The structure of claim 1 further characterized by the ribs having oversized fastener rib holes, said means comprising fasteners, the legs having fastener leg holes aligned with the oversize fastener rib holes and with said fasteners cooperable in secured relation therewith.

3. The curved concrete forming structure of claim 1 further characterized by each of the ribs being of a U-shaped metallic construction and having one rib leg welded to said flexible skin plate, cap plates welded to opposite ends of said ribs, the curved angles each having an angle leg secured on one side of each of the cap plates by said means.

4. The curved concrete forming structure of claim 1 further characterized by the flexible skin plate being comprised of steel and having a 3/16" thickness.

5. The curved concrete forming structure of claim 1 further characterized by the curved angles each being comprised of hot rolled steel characterized as ASTM A-36 steel and having a thickness of about ⅜".

6. The curved concrete forming structure of claim 1 further characterized by the curved angles having elongated slots, the curved angles each having one angle leg for disposition in overlying relation to said ribs, said securing means comprises fasteners, cover plates having elongated slots for receiving fasteners, and the fasteners extending through said elongated slots securing the curved angles to said cover plates and to said spaced vertical ribs.

7. The curved concrete forming structure of claim 1 further characterized by the curved angles having elongated slots provided in the upright angle legs for disposition in overlying relation to said ribs, the ribs having closure cover plates at opposite ends thereof secured in fixed assembly with one of said horizontal angle legs and said rib.

8. The forming structure of claim 1 further characterized by the ribs having closure plates provided at opposite ends thereof, the angles at each end of the ribs having lapped angle legs positioned in lapped relation to said closure plates, vertically aligned slots in said lapped angle legs and said cover plates, and said securing means comprises set of bolt and nut fasteners cooperable with said aligned slots securing the panels together when stacked in superimposed assembly together.

9. The forming structure of claim 8 further characterized by aligner plates being bolted to the curved angles on the adjoining stacked panels securing the stacked panels in vertical alignment.

10. The forming structure of claim further characterized as including confronting inner and outer curved forms each comprised of a series of stacked and side-by-side located groups of the arcuately curved metallic panels, tie bearing brackets bolted to said panels on the confronting inner and outer curved forms and ties extending through the panels on the confronting inner and outer curved forms and retainingly engaged with said tie bearing brackets securing the confronting forms in spaced apart relation.

11. The curved concrete forming structure of claim 1 further characterized by each of the ribs being of a U-shaped construction and having one terminal rib leg secured in side-by-side relation to said to said flexible skin plate, cap plates welded to vertically opposite ends of said ribs, said horizontal angle legs being positioned parallel to and secured to the cap plates by said means.

12. The structure of claim 11 further characterized by the ribs having oversized fastener rib holes, the angles each having a pair of legs, the legs having fastener leg holes aligned with the oversize fastener rib holes and with said means comprising fasteners cooperable in secured relation with said aligned holes.

13. In a curved concrete forming structure to provide a system for forming curved walls and including a series of arcuately curved metallic panels secured in stacked side-by-side assembly, the improvement wherein each panel includes a flexible metallic skin plate, spaced vertically extending ribs positioned along the length of the plate and secured thereto, the ribs and the skin plate having essentially the same vertical dimensions, a pair of vertically spaced arcuately curved angles having identical radii of curvature corresponding to the radii of curvature of the concrete wall to be poured using the concrete forming structure, the curved angles being substantially stiffer and inflexible compared to the flexible skin plate, the curved angles each having a corner, the curved angles being positioned in abutment with opposite ends of said ribs and with said corners being located in spaced relation to the associated curved metallic plate, said angles each having a horizontal leg with an outermost end remote from said corner associated therewith and with said outermost end being positioned for smooth edgewise engagement against said skin plate when secured by said fasteners, and fasteners securing the curved angles to the ends of the ribs and as the fasteners are secured, the flexible skin plate is moved from a flat form to a curved form corresponding in curvature to the arcuately curved angles to form said arcuately curved panel, the curved panels when assembled in stack assembly providing a smooth continuous radius free of chords or flat spots.

14. In a concrete forming structure to provide a system for forming curved walls and including a series of metallic panels secured in stacked side-by-side assembly, the improvement wherein each panel includes a flexible metallic skin plate, spaced vertically extending ribs positioned along the length of the plate on one side thereof in secured assembly with said panel, the ribs and the skin plate having essentially the same vertical dimensions, a pair of vertically spaced curved angles each having a corner, the curved angles being substantially stiffer and inflexible compared to the flexible skin plate, and means securing the angles in abutment with opposite ends of said ribs, and with the flexible skin plate being in a curved form and secured by said means, the panels being assembled in stacked assembly providing a smooth continuous forming surface, said angles each having a horizontal leg with an outermost end remote from said corner associated therewith and with said outermost end being positioned for smooth edgewise engagement against said skin plate when secured by said securing means, the corners of the angles being remote and spaced apart form the associated plate.

15. In a curved concrete forming structure to provide a system for forming curved walls having a radius in excess of 5 feet and including a series of arcuately curved metallic panels secured in stacked side-by-side assembly, the improvement wherein each panel includes a flexible metallic skin plate, spaced vertically extending ribs positioned along the length of the plate, the ribs and the skin plate having essentially the same vertical dimensions, a pair of vertically spaced arcuately curved angles having identical radii of curvature corresponding to the radii of curvature of the concrete wall to be poured using the concrete forming structure, the curved angles being substantially stiffer and inflexible compared to the flexible skin plate, the curved angles having corners positioned in abutment with opposite ends of said ribs, the corners of said angles being remotely spaced from said skin plate, and fasteners securing the curved angles to the ends of the ribs and as the fasteners are secured, the flexible skin plate is moved by said fasteners from a flat form to a curved form corresponding in curvature to arcuately curved angles to form said arcuately curved panel, said angles each having a horizontal leg with an outermost end remote from said corner associated therewith and with said outermost end being positioned for smooth edgewise engagement against said skin plate when secured by said fasteners, the curved panels when assembled in stacked assembly providing a smooth continuous radii free of chords or flat spots.

16. The forming structure of claim 15 further characterized as including confronting inner and outer curved forms each comprised of a series of stacked and side-by-side located groups of the arcuately curved metallic panels, tie bearing brackets bolted to said panels on the confronting inner and outer curved forms and ties extending through the panels on the confronting inner and outer curved forms and retainingly engaged with said tie bearing brackets securing the confronting forms in spaced apart relation.

17. The structure of claim 15 further characterized by the ribs having oversized fastener rib holes, the curved angles each having a pair of legs, the legs having fastener leg holes aligned with the oversize fastener rib holes and with said fasteners cooperable in secured relation therewith.

18. The curved concrete forming structure of claim 15 further characterized by each of the ribs being of a U-shaped metallic construction and having one rib leg welded to said flexible skin plate, cap plates welded to opposite ends of said ribs, said horizontal angle legs being secured on one side of each of the cap plates by said fasteners.

19. The curved concrete forming structure of claim 15 further characterized by the flexible skin plate being comprised of steel and having a 3/16" thickness.

20. The curved concrete forming structure of claim 15 further characterized by the curved angles each being comprised of hot rolled steel characterized as ASTM A-36 steel and having a thickness of about 3/8".

21. The curved concrete forming structure of claim 15 further characterized by the curved angles having elongated slots provided in one angle leg for disposition in overlying relation to said ribs, said leg having elongated slots for receiving said fasteners securing said angle leg to said rib, the ribs having closure cover plates at opposite ends secured in fixed assembly with said one angle leg and said rib.

22. The forming structure of claim 15 further characterized by the ribs having closure plates provided at opposite ends thereof the angles at each end of the ribs having lapped angle legs positioned in lapped relation to said closure plates, vertically aligned slots in said lapped angle legs and said cover plates, and said fasteners include a set of bolt and nut fasteners cooperable with said aligned slots securing the panels together when stacked in superimposed assembly together.

23. In a curved concrete forming structure to provide a system for forming curved concrete walls having a radius of at least 5 feet including confronting inner and outer curved forms each comprised of a series of stacked and side-by-side located groups of arcuately curved metallic panels, tie bearing brackets bolted to said panels on the confronting inner and outer curved forms, ties extending through the panels on the confronting inner and outer curved forms and retainingly engaged with said tie bearing brackets securing the confronting forms in predetermined spaced gap relation, the improvement wherein each panel includes a flexible metallic skin plate, spaced vertically extending ribs positioned along the length of the plate on one side thereof, the ribs and the skin plate having essentially the same vertical dimensions, a pair of vertically spaced arcuately curved angles having identical radii of curvature corresponding to the radii of curvature of the concrete wall to be poured using the concrete forming structure, the curved angles being substantially stiffer and inflexible compared to the flexible skin plate and each having a corner, and means securing the curved angles in abutment with opposite ends of said ribs leaving the corners of the angles remotely located in spaced relation to said skin plate, and with the flexible skin plate being moved from a flat form and secured by said means in a curved form corresponding in curvature to the arcuately curved angles to form said arcuately curved panel, the curved panels being assembled in stacked assembly providing a smooth continuous radius free of chords or flat spots, said angles each having a horizontal leg with an outermost end remote from said corner associated therewith and with said outermost end being positioned for smooth edgewise engagement against said skin plate when secured by said securing means.

24. The forming structure of claim 23 further characterized by the ribs on the panel having closure plates provided at opposite ends thereof, the angles at each end of the ribs having lapped angle legs positioned lapped relation to said closure plates, vertically aligned slots in said lapped angle legs and said closure plates, and said securing means includes a set of bolt and nut fasteners cooperable with said aligned slots securing the panels together when stacked in superimposed assembly together.

25. The forming structure of claim 23 further characterized by the ribs having closure plates provided at opposite ends thereof, the angles at each end of the ribs having lapped angle legs positioned in lapped relation to said closure plates, first vertically aligned slots in said lapped angle legs and said closure plates, and said securing means includes a first set of bolt and nut fasteners cooperable with said first aligned slots securing the panels together when stacked in superimposed assembly together, upright angle legs positioned in upright lapped relation to the opposite ends of said ribs, second aligned slots in the upright angle legs and the opposite ends of said ribs, and said securing means further includes a second set of fasteners cooperable with said second aligned slots securing the upright angle legs to the opposite ends of said ribs.

26. The forming structure of claim 23 further characterized by aligner plates being bolted to the curved angles on the adjoining stacked panels securing the stacked panels in vertical alignment.

27. The concrete forming structure of claim 23 further characterized by the curved angles each being comprised of hot rolled steel and being approximately 3/8" thick, the skin plate having a thickness of approximately 3/16".

28. In a curved concrete forming structure to provide a system for forming curved and circular concrete walls having a radius in excess of 5 feet and including a series of arcuately curved metallic panels secured in stacked side-by-side assembly, the improvement wherein each panel includes a flexible metallic skin plate, spaced vertically extending ribs positioned along the length of the plate on one side thereof, the ribs and the skin plate having essentially the same vertical dimensions, a pair of vertically spaced arcuately curved angles having identical radii of curvature corresponding to the radii of curvature of the concrete wall to poured using the concrete forming structure, the curved angles being substantially stiffer and inflexible compared to the flexible skin plate, and means securing the curved angles in abutment with opposite ends of said ribs, and with the flexible skin plate being moved from a flat form and secured by said means in a curved form corresponding in curvature to the arcuately curved angles to form said arcuately curved panel, the curved panels being assembled in stacked assembly as a gang providing a smooth continuous radius of curvature free of chords or flat spots, the ribs having oversized fastener rib holes, the curve angles each having a pair of legs, the legs having fastener leg holes aligned with the oversize fastener rib holes and with said fasteners cooperable in secured relation therewith.

29. In a curved concrete forming structure to provide a system for forming curved and circular concrete walls having a radius in excess of 5 feet and including a series of arcuately curved metallic panels secured in stacked side-by-side assembly, the improvement wherein each panel includes a flexible metallic skin plate, spaced vertically extending ribs positioned along the length of the plate on one side thereof, the ribs and the skin plate having essentially the same vertical dimensions, a pair of vertically spaced arcuately curved angles having identical radii of curvature corresponding to the radii of curvature of the concrete wall to be poured using the concrete forming structure, the curved angles being substantially stiffer and inflexible compared to the flexible skin plate, and means securing the curved angles in abutment with opposite ends of said ribs, and with the flexible skin plate being moved from a flat form and secured by said means in a curved form corresponding in curvature to the arcuately curved angles to form said arcuately curved panel, the curved panels being assembled in stacked assembly as a gang providing a smooth continuous radius of curvature free of chords or flat spots, each of the ribs being of a U-shaped metallic construction and having one rib leg welded to said flexible skin plate, cap plates welded to opposite ends of said ribs, the curved angles having angle legs secured on one side of each of the cap plates by said means.

30. The structure of claim 29 further characterized by the ribs having oversized fastener rib holes, the angles each having a pair of legs, the legs having fastener leg holes aligned with the oversize fastener rib holes and with said means comprising fasteners cooperable in secured relation therewith.

31. In a curved concrete forming structure to provide a system for forming curved and circular concrete walls having radius in excess of 5 feet and including a series of arcuately curved metallic panels secured in stacked side-by-side assembly, the improvement wherein each panel includes a flexible metallic skin plate, spaced vertically extending ribs positioned along the length of the plate on one side thereof, the ribs and the skin plate having essentially the same vertical dimensions, a pair of vertically spaced arcuately curved angles having identical radii of curvature corresponding to the radii of curvature of the concrete wall to be poured using the concrete forming structure, the curved angles being substantially stiffer and inflexable compared to the flexible skin plate, and means securing the curved angles in abutment with opposite ends of said ribs, and with the flexible skin plate being moved from a flat form and secured by said means in a curved form corresponding in curvature to the arcuately curved angles to form said arcuately curved panel, the curved panels being assembled in stacked assembly as a gang providing a smooth coninuous radius of curvature free of chords or flat spots, cover plates secured to said opposite ends of said ribs, said securing means comprising fasteners, the curved angles having elongated slots, the curved angles having one angle leg for disposition in overlying relation to said ribs and the cover plates, the cover plates having elongated slots for receiving fasteners, and the fasteners extending through said elongated slots securing the curved angles to said cover plates and to said spaced vertical ribs.

32. The forming structure of claim 31 further characterized by the angles at each end of the ribs having lapped angle legs positioned in lapped relation to said cover plates, vertically aligned slots in said lapped angle legs and said cover plates, and said fasteners include a set of bolt and nut fasteners cooperable with said aligned slots securing the panels together when stacked in superimposed assembly together.

33. In a curved concrete forming structure to provide a system for forming curved and circular concrete walls having a radius in excess of 5 feet and including a series of arcuately curved metallic panels secured in stacked side-by-side assembly, the improvement wherein each panel includes a flexible metallic skin plate, spaced vertically extending ribs positioned along the length of the plate on one side thereof, the ribs and the skin plate having essentially the same vertical dimensions, a pair of vertically spaced arcuately curved angles having identical radii of curvature corresponding of the radii of curvature of the concrete wall to be poured using the concrete forming structure, the curved angles being substantially stiffer and inflexible compared to the flexible skin plate, and means securing the curved angles in abutment with opposite ends of said ribs, and with the flexible skin plate being moved from a flat form and secured by said means in a curved form corresponding in curvature to the arcuately curved angles to form said arcuately curved panel, the curved panels being assembled in stacked assembly as a gang providing a smooth continuous radius of curvature free of chords or flat spots, the ribs having closure plates providing at opposite ends, the angles at each end of the ribs having a lapped angle leg positioned in lapped relation to said closure plates, vertically aligned slots in said lapped angle legs and said cover plates, and said securing means comprises a set of bolt and nut fasteners cooperable with said aligned slots securing the panels together when stacked in superimposed assembly together.

34. The forming structure of claim 33 further characterized by aligner plates being bolted to the curved angles on the adjoining stacked panels securing the stacked panels in vertical alignment.

35. In a curved concrete forming structure to provide a system for forming curved concrete walls having a radius of at least 5 feet including confronting inner and outer curved forms each comprised of a series of stacked and side-by-side located groups of arcuately curved metallic panels, tie bearing brackets bolted to said panels on the confronting inner and outer curved forms, ties extending through the panels on the confronting inner and outer curved forms and retainingly engaged with said tie bearing brackets securing the confronting forms in predetermined spaced gap relation, the improvement wherein each panel includes a flexible metallic skin plate, spaced vertically extending ribs positioned along the length of the plate on one side thereof, the ribs and the skin plate having essentially the same vertical dimensions, a pair of vertically spaced arcuately curved angles having identical radii of curvature corresponding to the radii of curvature of the concrete wall to be poured using the concrete forming structure, the curved angles being substantially stuffer and inflexible compared to the flexible skin plate, and actuatable means securing the curved angles in abutment with opposite ends of said ribs, and with the flexible skin plate being moved from a flat form as the actuatable means becomes tightly engaged causing the flexible skin plate to assume a curved form corresponding in curvature to the arcuately curved angles to form said arcuately curved panel, the curved panels being assembled in stacked assembly providing a smooth continuous radius of curvature free of chords or flat spots, the ribs on the panel having closure plates provided at opposite ends, the angles at each end of the ribs having lapped horizontal angle legs positioned in lapped relation to said closure plates, first vertically aligned slots in said lapped angle legs and said closure plates, and said actuatable means includes a set of bolt and nut fasteners cooperable with said firstd aligned slots securing the panels together when stacked in superimposed assembly together.

36. The forming structure of claim 35, wherein the curved angles further comprise upright angle legs positioned in upright lapped relation to the opposite ends of said ribs, second aligned slots in the upright angle legs and the opposite ends of said ribs, and said actuatable means further includes a second set of fasteners cooperable with said second aligned slots securing the upright angle legs to the opposite ends of said ribs.

37. The forming structure of claim 36 further characterized by aligner plates being bolted to the curved angles on the adjoining stacked panels securing the stacked panels in vertical alignment.

* * * * *